United States Patent [19]

Lupton et al.

[11] 4,185,483

[45] Jan. 29, 1980

[54] DOOR LOCKING DEVICE

[76] Inventors: Stephanie Lupton; Mary Lupton, both of 505 N. Lake Shore, Chicago, Ill. 60611

[21] Appl. No.: 895,621

[22] Filed: Apr. 12, 1978

[51] Int. Cl.[2] ..... E05B 13/00

[52] U.S. Cl. ..... 70/416

[58] Field of Search ..... 70/416, 431, 447, 14, 70/1; 292/342, 343, 346, DIG. 2, 92, 292

[56] References Cited

U.S. PATENT DOCUMENTS

| | | | |
|---|---|---|---|
| 1,676,284 | 7/1928 | Powell | 292/343 |
| 1,939,402 | 12/1933 | Moser | 292/343 |
| 2,463,195 | 3/1949 | Mungas | 70/416 |

*Primary Examiner*—Robert L. Wolfe

*Attorney, Agent, or Firm*—Laff, Whitesel & Rockman

[57] ABSTRACT

A door locking device comprising a six-sided right wedge frustum having two spaced parallel sides and parallel upper and lower bases with a first remaining side perpendicular to the upper and lower bases and a second remaining side cut at an angle with respect to the upper and lower bases. The device is securely placed between the door handle stem and the key latch to prevent the latch from rotating if an intruder attempts to place a key in the lock and rotate the tumblers, since the latch is connected directly to the tumblers.

3 Claims, 3 Drawing Figures

DOOR LOCKING DEVICE

BACKGROUND OF INVENTION

In recent years, the public has shown an increasing concern for the many problems created by the rising crime rate throughout the country. As a result, various devices have been designed to protect against the picking of door locks. Most of these devices, however, do not provide an economical solution to the problem and are not portable.

The present invention takes advantage of the fact that key latches on the inside of many residential entrance doors are directly connected to the tumblers of the door lock. Therefore, whenever a key is inserted and turned, the tumblers and the latch must turn. By preventing the latch from turning, one can effectively prevent a clandestine key from turning the lock and opening the door.

SUMMARY OF THE INVENTION

An object of the present invention is to provide means for disabling the operation of a key lock by preventing the key latch from turning after the lock has been engaged.

Another object of the present invention is to provide means comprising a wedge-like structure which is adapted to fit between the key latch and door handle on the inside of a locked door, whereby the wedge-like structure prevents the key latch from turning.

In keeping with these and other objects of our invention, we provide a six-sided wedge-shaped device made of a relatively hard material, such as hard rubber or the like, by way of example. The invention is adapted to be inserted from the left between the door handle and key latch of a locked door, and firmly held in place by the wedge-like device. When so inserted, the hardness of the material prevents the key latch from turning, thereby preventing a clandestine intruder from opening the door, even though the intruder may be in possession of a key.

These and other objects of the present invention will become apparent from a description of the preferred embodiment of our invention, when read in conjuction with the accompanying drawing.

DETAILED DESCRIPTION OF THE INVENTION

Figure 1:
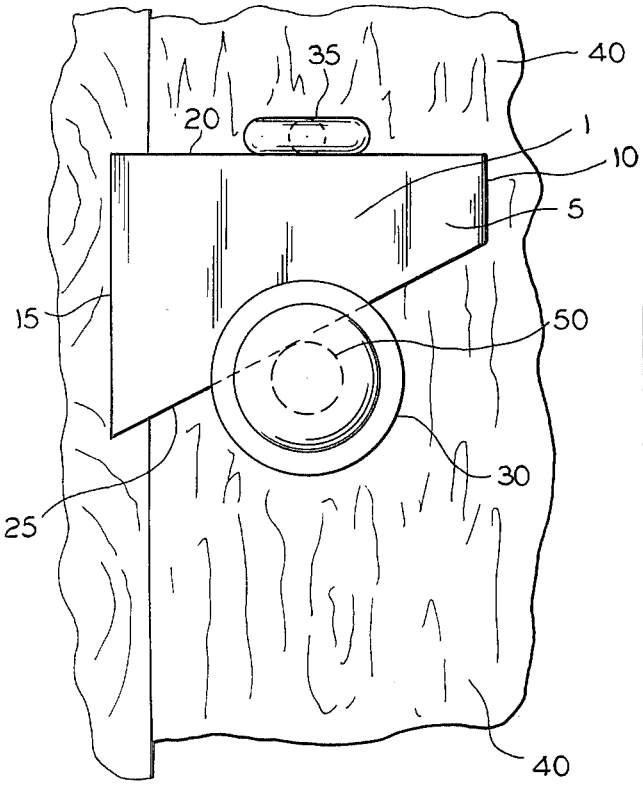
FIG. 1 is a side view in elevation of a device according to the present invention showing the device in place between the handle and key latch of a door.

Referring now in detail to the drawing, the door locking device of the present invention comprises a six-sided wedge 1, preferably made of hard rubber or some suitable hard substance, having two spaced parallel sides 5, paralled upper and lower bases, 10 and 15, respectively, with side 20 perpen

We claim:

1. A protable locking device for a door comprising, in combination, a key-operated lock for said door;

said lock including tumblers therein which are adapted to be rotated by said key;

key latch means connected to said tumblers and adapted to turn with said tumblers as said tumblers are rotated by said key;

said door including opening means operated by a handle having a stem extending from said door;

said stem located in relative close proximity to said key latch;

wedge means inserted between and in abutment with said stem and said key latch means, whereby said key latch cannot be rotated when said wedge means is inserted between said stem and said key latch.

2. The portable locking device of claim 1 wherein said wedge means is made of hard rubber.

3. A method to prevent a key latch on a door from rotating where the key latch is connected to the locking tumblers and the stem of the door handle is located in relative close proximity to the key latch, comprising the steps of:

forming a six-sided right wedge frustum having two spaced parallel sides and parallel upper and lower bases with a first remaining side perpendicular to said upper and lower bases and a second remaining side cut at an angle with respect to said upper and lower bases; and inserting said wedge frustum between and in abutment with the stem of the door handle and the key latch, whereby the key latch cannot be rotated when said wedge is inserted between the stem and key latch.

* * * * *

UNITED STATES PATENT AND TRADEMARK OFFICE

CERTIFICATE OF CORRECTION

PATENT NO. : 4,185,483

DATED : January 29, 1980

INVENTOR(S) : Stephanie Lupton; Mary Lupton

It is certified that error appears in the above-identified patent and that said Letters Patent are hereby corrected as shown below:

Column 2, line 18, after "perpen", insert:

--dicular to bases 10 and 15. Side 25 is cut at an angle to bases 10 and 15, so that base 10 is shorter in length than base 15.

Figure 2:
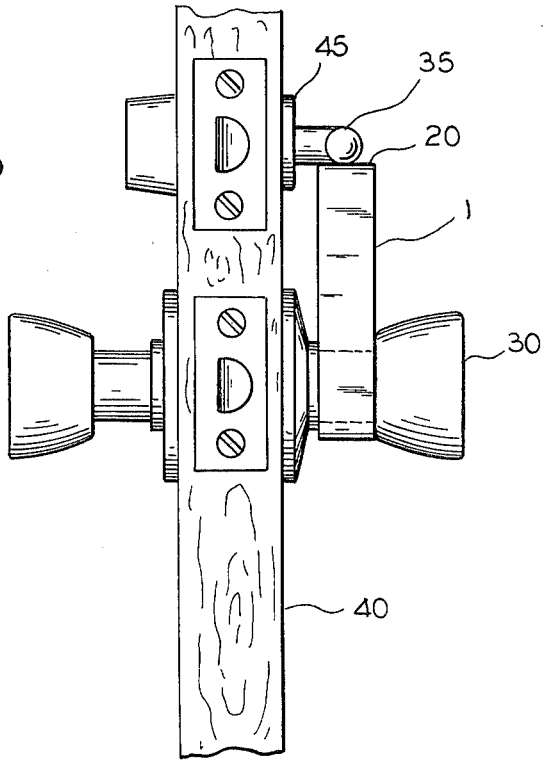
FIG. 2 is a side view in elevation of the device of FIG. 1.
Figure 3:
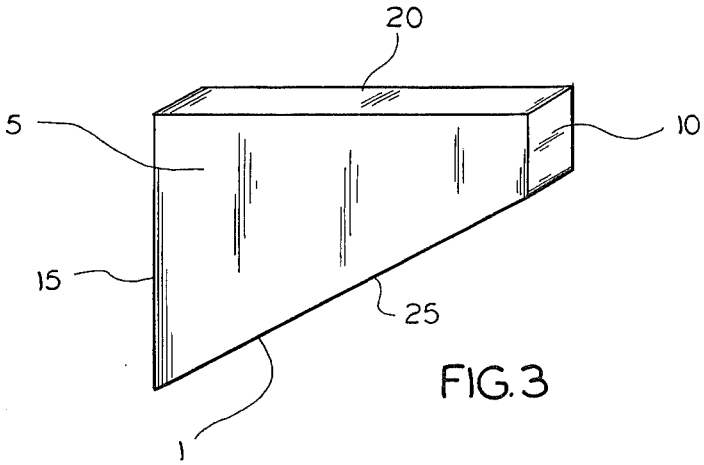
FIG. 3 is a perspective view of a device according to the present invention.

As shown in Figs. 1 and 2, door 40 comprises lock 45 and handle 30. Lock 45 is designed to be operated from the outside by a key and from the inside by latch 35. Handle 30 is disposed on the end of stem 50, as shown in Fig. 1.

To use our invention, door 40 is locked by turning latch 35 in a clockwise direction. Latch 35 is then in a horizontal position. Wedge 1 is next inserted from the left between and in abutment with the stem 50 of handle 30 and latch 35 of lock 45, as shown in Figs. 1 and 2. Any attempt to open lock 45 with a key from the outside of the door would normally cause latch 35 to rotate in a counterclockwise direction. However, since wedge

UNITED STATES PATENT AND TRADEMARK OFFICE

CERTIFICATE OF CORRECTION

PATENT NO. : 4,185,483

DATED : January 29, 1980

INVENTOR(S) : Stephanie Lupton; Mary Lupton

It is certified that error appears in the above-identified patent and that said Letters Patent are hereby corrected as shown below:

1 has been securely inserted between latch 35 and door handle stem 50 from the left, any turning movement of latch 35 in a counterclockwise, unlocking direction will cause wedge 1 to become more firmly inserted between latch 35 and stem 50. Thus, key latch 35 is prevented from turning and lock 45 is thereby prevented from being unlocked by use of a key from the outside.

While the principles of our invention have been described above in connection with specific embodiments and applications, it is to be understood that this description is made only by way of example and not as a limitation on the scope of the appended claims.--

Signed and Sealed this

*Twenty-fourth* Day of *June 1980*

[SEAL]

*Attest:*

SIDNEY A. DIAMOND

*Attesting Officer*

*Commissioner of Patents and Trademarks*